US005975515A

United States Patent [19]

Capri et al.

[11] Patent Number: 5,975,515

[45] Date of Patent: Nov. 2, 1999

[54] SYSTEM FOR DESIGNATING PAPER CASSETTES IN PRINTERS AND COPIERS

[75] Inventors: Sandra Capri, Eagle; Tim M. Hoberock, Boise, both of Id.

[73] Assignee: Hewlett-Packard Company, Palo Alto, Calif.

[21] Appl. No.: 08/803,727

[22] Filed: Feb. 21, 1997

[51] Int. Cl.[6] ..... B65H 3/44

[52] U.S. Cl. ..... 271/9.11; 271/145

[58] Field of Search ..... 271/9.01, 9.11, 271/145, 162, 171

[56] References Cited

U.S. PATENT DOCUMENTS

| | | | |
|---|---|---|---|
| 5,188,351 | 2/1993 | Gysling | 271/171 |
| 5,539,512 | 7/1996 | Mui | 271/171 |
| 5,572,310 | 11/1996 | Hoberock et al. | 271/145 |
| 5,785,308 | 7/1998 | Flores et al. | 271/162 |

FOREIGN PATENT DOCUMENTS

| | | | |
|---|---|---|---|
| 0007841 | 1/1981 | Japan | 271/171 |
| 402193824 | 7/1990 | Japan | 271/9.11 |
| 404159945 | 1/1992 | Japan | 271/145 |

*Primary Examiner*—H. Grant Skaggs

[57] ABSTRACT

A system for designating individual paper holders in printers and copiers that use interchangeable paper holders, paper cassettes, paper trays and the like. The invention provides a paper supply which is capable of automatically changing its identifying indicia dependent upon its position within a group of similar paper supplies. For example, if a paper tray was positioned in the third position within a stack of paper trays, it would automatically adjust its identifying indicia to reflect that it is the "third" paper tray. Using the invented designation system, the paper holders may be automatically designated according to their placement in the printer or copier. The system includes a movable designator, typically a number designator, connected to and viewable on the paper holder. The designator is operable to move between two positions. When the designator is in the first position, the designator is not visible on the paper holder. When the designator is in the second position, the designator is visible on the paper holder.

7 Claims, 8 Drawing Sheets

SYSTEM FOR DESIGNATING PAPER CASSETTES IN PRINTERS AND COPIERS

FIELD OF THE INVENTION

The invention relates generally to image forming machines such as printers and copiers. More particularly, the invention relates to a system for designating individual paper cassettes in printers and copiers.

BACKGROUND OF THE INVENTION

In conventional printers and copiers, sheets of paper or other sheet media are pulled from a stack and fed downstream into the print engine components where the desired image is formed on each sheet. The sheets of paper are stacked in a cassette, tray or similar type of paper holder. Many printers and copiers use multiple paper holders. The paper holders may hold different types, sizes or color paper. Each holder may be a cassette assembly that includes paper feed components, such as a feed roller, shaft and gears, or the holder may be simply a paper tray fitted in a plastic housing. Whatever their configuration or function, the paper holders usually have some type of externally visible designator to distinguish between and among the multiple holders. For example, multiple paper holders are often designated by number, 1, 2, 3 etc.

Presently, the paper holder designators are affixed to, stamped in or embossed on each holder. This presents a problem for printers or copiers that can use two or more interchangeable paper holders. For example, some printers such as the one depicted in FIG. 1 use two optional paper cassette/feeder assemblies in addition the two paper trays mounted within the printer housing. The paper trays are designated paper holders number 1 and 2. The optional cassettes are designated paper holders number 3 and 4. Optional cassettes 3 and 4 are interchangeable. One or both of the optional cassettes may be used at any given time. If a fixed number designator is used for each cassette, then two separate cassettes each having a different number designator must be stocked and sold and used in the correct sequence by the customer. This same problem exists for the paper trays designated as paper holders number 1 and 2 if they are also interchangeable with one another. Such designation systems add undesirable costs and handling complexity to printers and copiers that utilize two interchangeable paper holders.

SUMMARY OF THE INVENTION

The present invention is directed to a system for designating individual paper or other print media holders in printers and copiers that use interchangeable holders, cassettes, trays and the like. For convenience, print media will now be referred to simply as paper, which shall be deemed to include all forms of print media. The invention provides a paper supply which is capable of automatically changing its identifying indicia dependent upon its position within a group of similar paper supplies. For example, if a paper tray was positioned in the third position within a stack of paper trays, it would automatically adjust its identifying indicia to reflect that it is the "third" paper tray. Using the invented designation system, the paper holders may be automatically designated according to their placement in the printer or copier.

At its most elemental level, the system includes a movable designator, typically a number designator, connected to and viewable on the paper holder. The designator is operable to move between two positions. When the designator is in the first position, the designator is not visible on the paper holder. When the designator is in the second position, the designator is visible on the paper holder. Preferably, the system uses two or more designators connected to and viewable on the same paper holder. In a two designator system (first and second designators), at least one of the designators, the second designator, for example, is operable to move between a first position wherein only the first designator is visible on the paper holder and a second position wherein only the second designator is visible on the paper holder. The first designator may be fixed, in which case it is covered by the second designator when the designators are in the second position and only the second designator is visible. Or, the first designator may be moveable, in which case it moves into or out of view as the designators move between the first and second positions.

These and other features of the invention, as well as various exemplary embodiments of the invention, are illustrated in the drawings and described more fully in the following detailed description.

DESCRIPTION OF THE DRAWINGS

In FIG. 3, the cassette is viewed from the bottom. In FIG. 4, the cassette is viewed from the top.

DETAILED DESCRIPTION OF THE INVENTION

Figure 1:
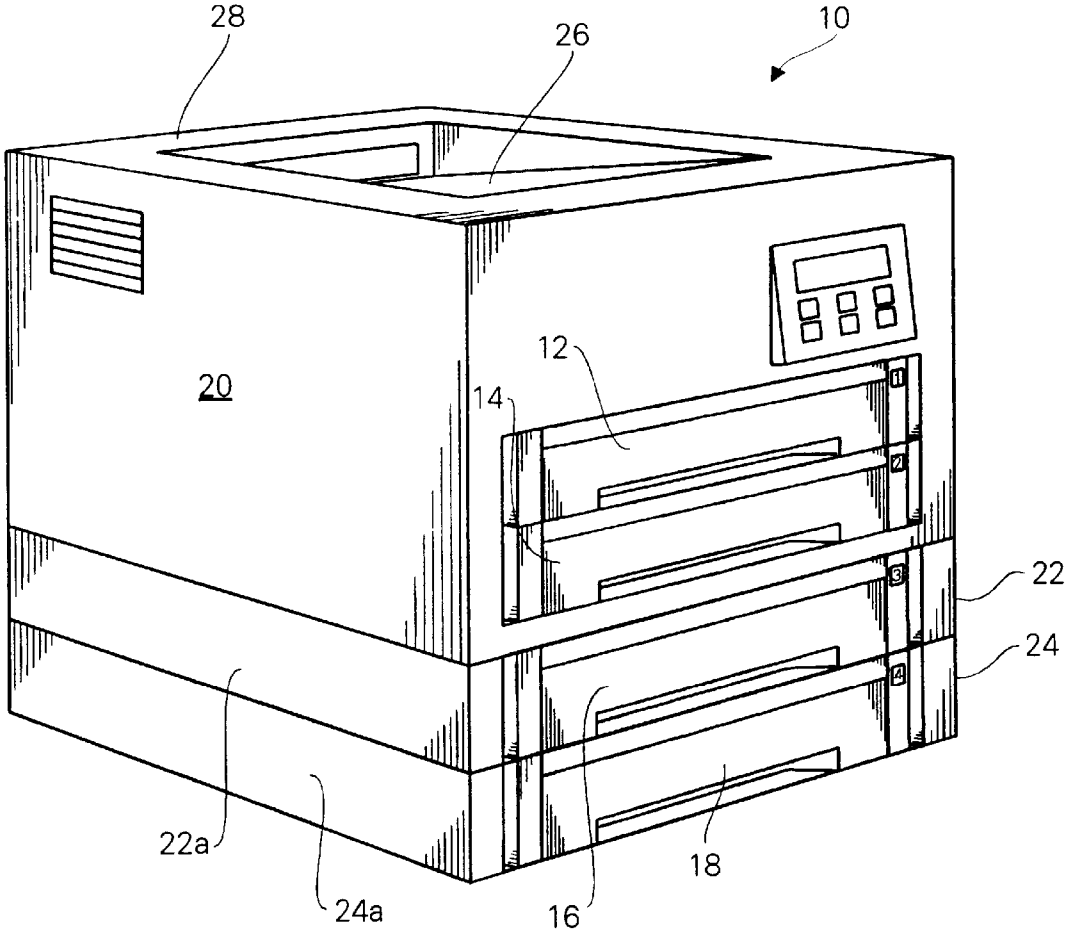
FIG. 1 is a perspective view of a printer with two removable interchangeable paper cassettes that use a two position designator flag.

Referring to FIG. 1, printer 10 uses up to four paper supply trays 12, 14, 16 and 18. Paper trays 12 and 14 are installed in the main printer housing 20. Paper trays 16 and 18 are installed in paper cassettes 22 and 24, respectively. Sheets of paper are pulled from one of the paper trays 12–18 into the print engine components where the desired image is formed on each sheet. The printed sheets are outputted to a paper collection area 26 located in the top portion 28 of printer housing 20. Paper trays 12–18 may be fully interchangeable with one another, they may be selectively interchangeable with one or more of the other paper trays, or they may be dedicated to a particular position in the printer or paper cassettes. Paper cassettes 22 and 24 are installed below the main printer housing 20. Each paper cassette 22, 24 is a paper feeder unit that includes a paper tray as well as a drive mechanism, feed roller, gear and shaft necessary to convey sheets of paper to the print engine in the main printer housing 20. Paper cassettes 22 and 24 are interchangeable with one another. Paper cassettes 22 and 24 are commonly referred to as "optional" paper cassettes because they are not necessary to the operation of the printer. That is, either or both or neither of these optional paper cassettes may be installed on the printer at any particular time.

Figure 2:
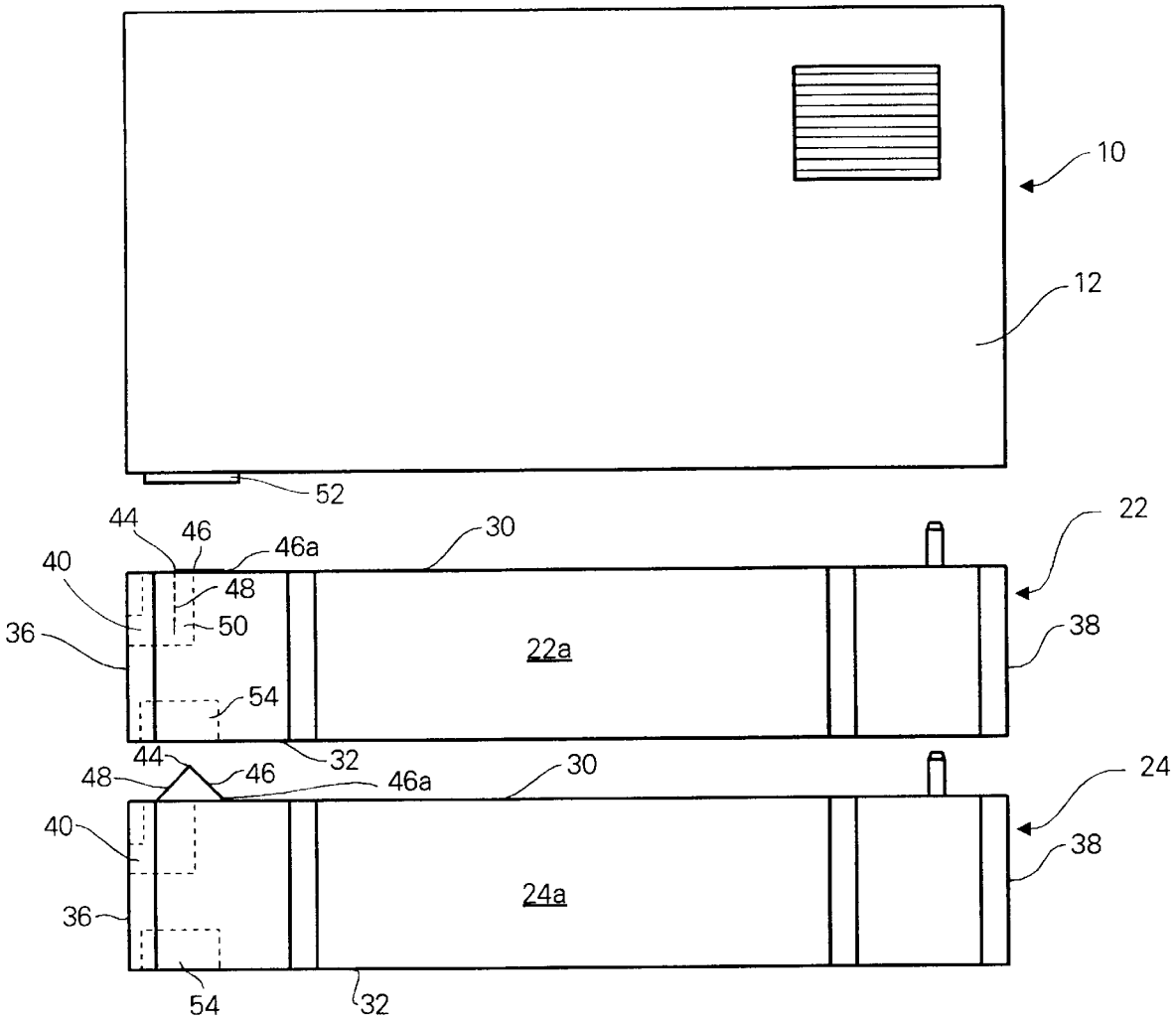
FIG. 2 is an exploded side view of the printer and paper cassettes shown in FIG. 1.
Figure 3:
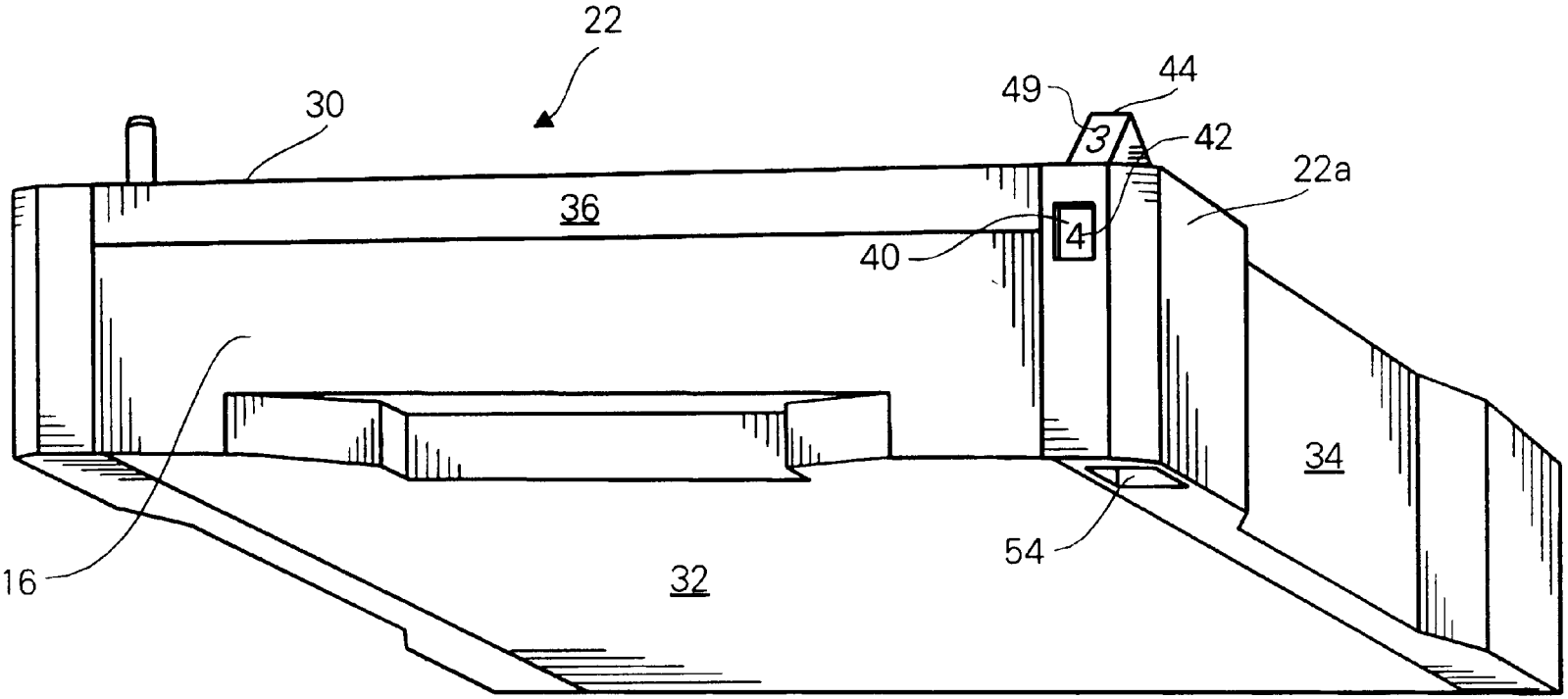
FIGS. 3 and 4 are perspective views of one of the interchangeable paper cassettes shown in FIGS. 1 and 2.
Figure 4:
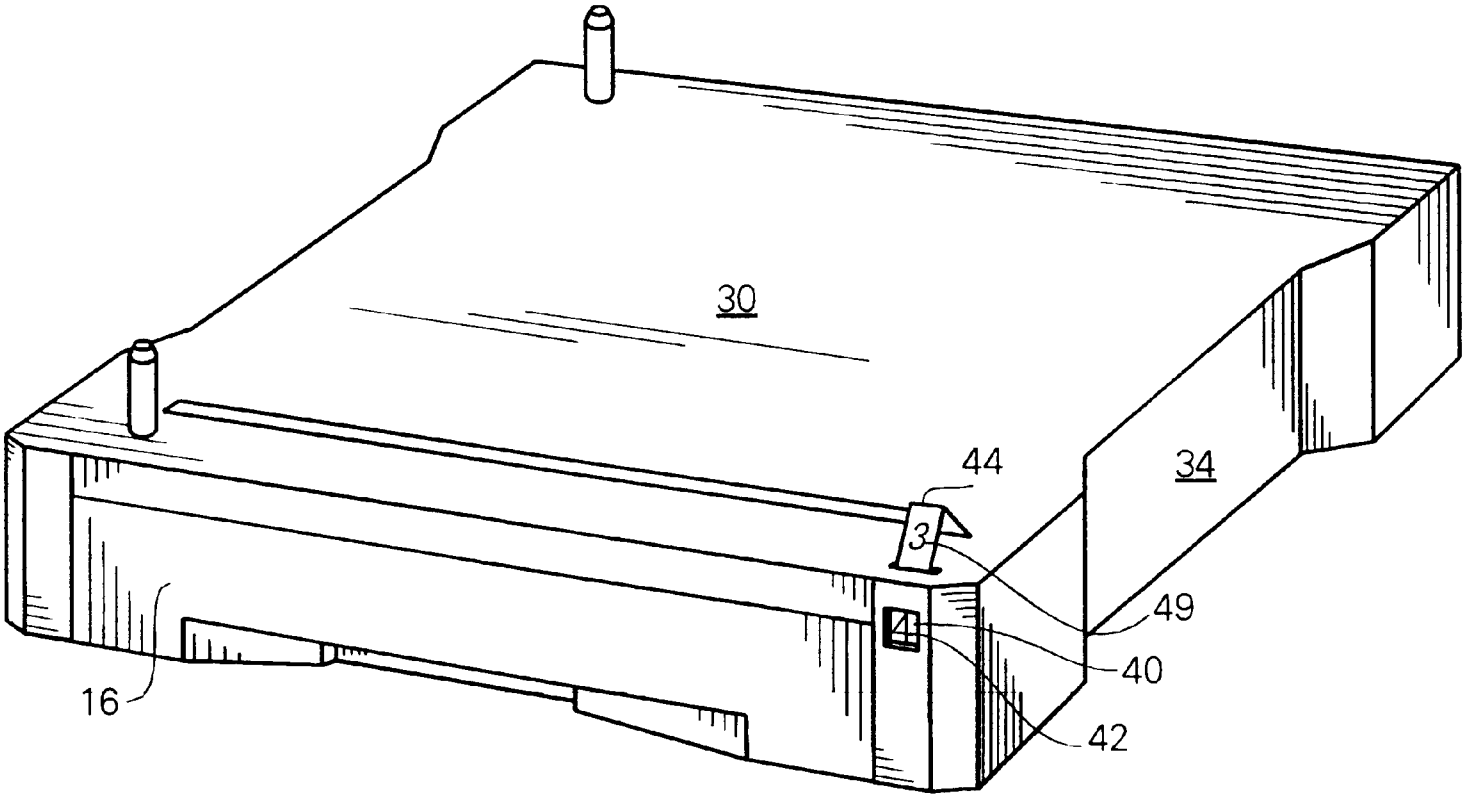

Referring to FIGS. 2–4, cassette housings 22*a,* 24*a* house the operative components of each paper cassette 22, 24. Each cassette housing 22*a,* 24*a* is defined generally by a top portion 30, bottom portion 32, sidewalls 34, front wall 36 and rear wall 38. A designator viewing window 40 is formed on the front 36 of each paper cassette housing 22*a,* 24*a*. A first number designator 42 (number "4" in FIGS. 3 and 4) appears at the back of window 40. A number designator flag 44 is attached to top portion 30 of each paper cassette housing 22*a,* 24*a* immediately above and adjacent to window 40. Designator flag 44 is an L shaped member. The first leg 46 of flag 44 is attached at its free end 46*a* to the top portion 30 so that the flag 44 pivots about the point of attachment, as best seen by comparing the position of flag 44 in cassettes 22 and 24 in FIG. 2. The second leg 48 of flag 44 moves into and out of window 40 through passage 50. A second number designator 49 (number "3" in FIGS. 3 and 4) appears on second leg 48 of flag 44. Flag 44 is operable to move from a first position, wherein the number designator 49 on second leg 48 of flag 44 is not displayed in window 40 (flag 44 on cassette 24 in FIG. 2), and a second position, wherein the number designator 49 on second leg 48 of flag 44 is displayed in window 40 (flag 44 on cassette 22 in FIG. 2).

Designator flag 44 is activated to move from the first position into the second position when the paper cassette is installed under the printer housing 12. When printer 10 is placed on top of a paper cassette, the bottom of main printer housing 12 depresses flag 44 into the second position, wherein the number on flag 44 is displayed in window 40. As shown in FIG. 2, a localized raised region 52 or "flat" on the bottom of printer housing 12 may be formed over designator flag 44 if necessary to ensure that flag 44 is depressed when the printer is placed on the paper cassette.

A void 54 is positioned directly below designator flag 44 at the bottom portion 32 of each cassette housing 22*a,* 24*a*. Void 54 is sized, shaped and positioned so that, when one paper cassette is stacked on top of another, the top cassette does not engage or depress the designator flag of the bottom cassette. According to this system, therefore, the paper cassette installed immediately below the printer (cassette 22 in FIG. 2) will always be designated cassette number 3 and the other paper cassette (cassette 24 in FIG. 2) will always be designated cassette number 4.

Figure 5:
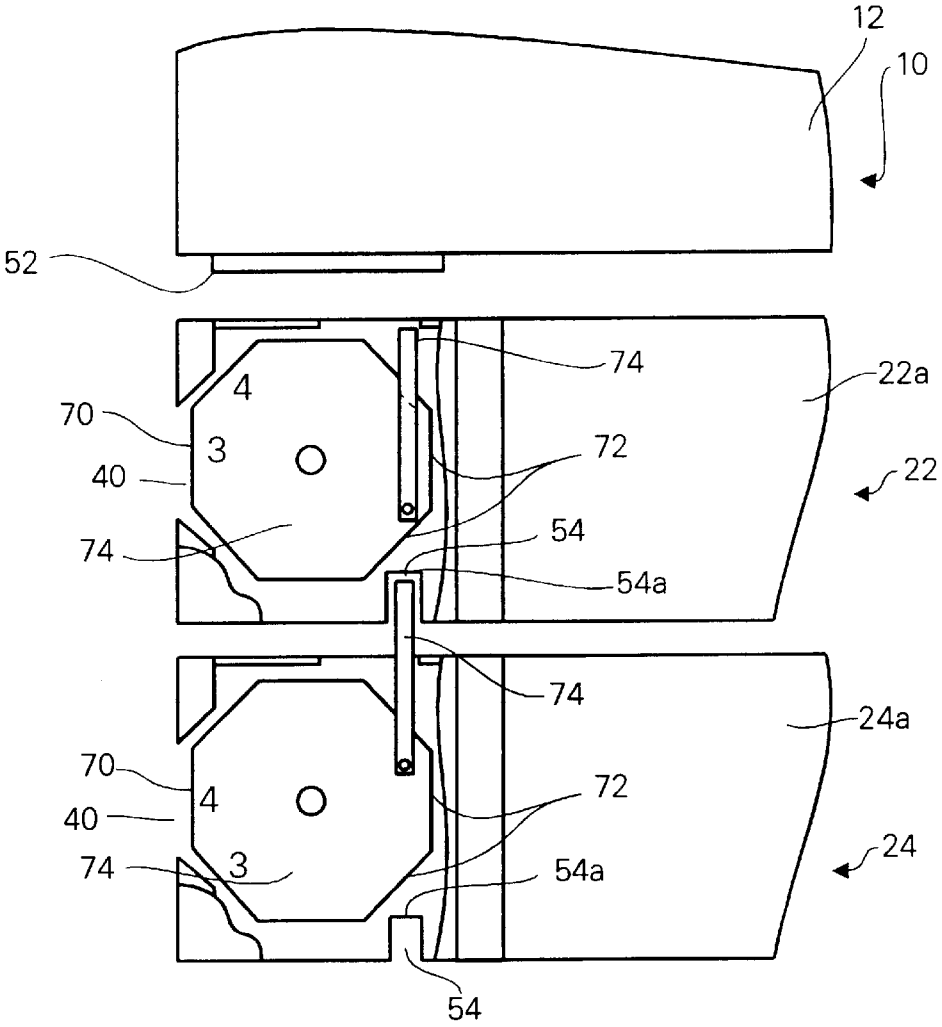
FIG. 5 is an exploded side view of a printer and paper cassettes that use a two position designator wheel.

In an alternative embodiment of the invention shown in FIG. 5, a wheel is used to designate the optional paper cassettes. Referring to FIG. 5, designator wheel 70 is positioned in viewing window 40 of each paper cassette housing 22*a,* 24*a*. Cassette designator numbers are printed on or otherwise affixed to the perimeter of wheel 70. Preferably, each number is printed on a series of facets 72 formed around the perimeter of wheel 70. An actuator rod 74 is attached to and pivots about an off center point on wheel 70 so that wheel 70 turns when actuator rod 74 is pushed or pulled. Wheel 70 is operative to move between a first position, illustrated by cassette 24, and a second position, illustrated by cassette 22. When wheel 70 is in the first position, cassette designation number 4 appears in window 40 and actuator rod 74 is raised.

When wheel 70 is in the second position, cassette designation number 3 appears in window 40 and actuator rod 74 is lowered. Wheel 70 is biased to the first position using a spring or other suitable biasing mechanism.

Wheel 70 is activated to move from the first position into the second position when the paper cassette is installed under the printer 10. When printer 10 is placed on top of a paper cassette, the bottom of main printer housing 12 depresses actuator rod 74 to rotate wheel 70 from the first position into the second position. A void 54 is positioned directly below wheel 70 at the bottom portion 32 of each cassette housing 22*a,* 24*a*. Void 54 is sized, shaped and positioned so that, when one paper cassette is stacked on top of another, the actuator rod of the lower cassette extends into the void in the upper cassette. Preferably, void 54 is made deep enough so that no contact is made between the actuator rod of the lower cassette and the back wall 54*a* of void 54 in the upper cassette. That is, the upper cassette does not engage or depress the actuator rod 74 of the lower cassette. Thus, the paper cassette installed immediately below the printer (cassette 22 in FIG. 5) will always be designated cassette number 3 and the other paper cassette (cassette 24 in FIG. 5) will always be designated cassette number 4.

Figure 6:
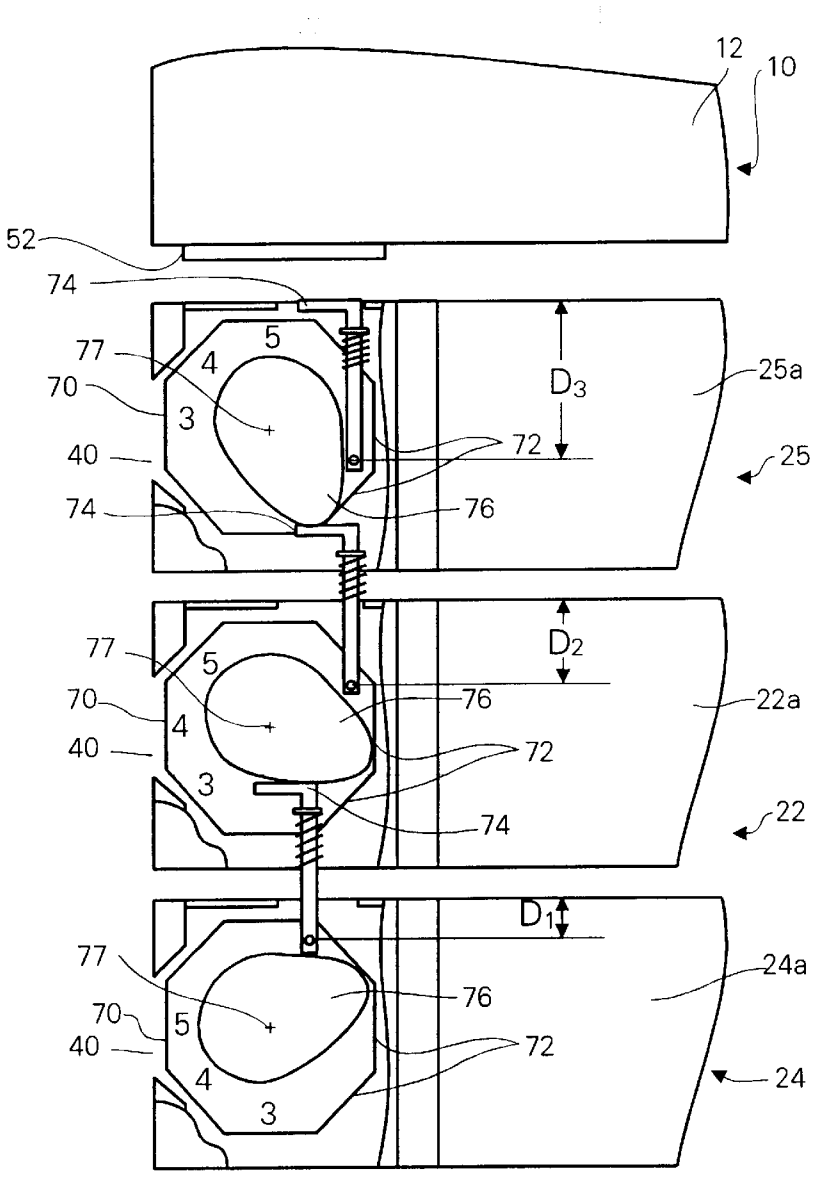
FIG. 6 is an exploded side view of the wheel type designator of FIG. 5 adapted to designate more than two cassettes.

FIG. 6 illustrates an adaptation of the wheel type designator for more than two number designations. In this embodiment, a cam 76 is coupled to wheel 70. Wheel 70 and cam 76 rotate about a common axis 77. The actuator rods 74 of the lower cassettes 22 and 24, which now also function as cam followers, project up into housing 25*a* of upper most cassette 25 and housing 22*a* of middle cassette 22. Wheel 70 and cam 76 are operative to move between a first position, illustrated by cassette 24, a second position, illustrated by cassette 22, and a third position, illustrated by cassette 25. When wheel 70 is in the first position, cam 76 engages and depresses actuator rod 74 a first distance $D_1$ so that cassette designation number 5 appears in window 40. When wheel 70 is in the second position, cam 76 engages and partially depresses actuator rod 74 a second distance $D_2$ so that cassette designation number 4 appears in window 40. When wheel 70 is in the third position, the bottom of printer housing 12 fully depresses actuator rod 74 a distance $D_3$ so that cassette designation number 3 appears in window 40. Wheel 70 and cam 76 are configured so that the incremental distances $D_3$–$D_2$ and $D_2$–$D_1$ corresponds to the rotation of wheel 70 from one facet 72 to another. Wheel 70 is biased to the first position using a spring or other suitable biasing mechanism.

Wheel 70 and cam 76 are activated to move into the third position when the paper cassette is installed under printer 10. As printer 10 is placed on top of the paper cassette, the bottom of main printer housing 12 fully depresses actuator rod 74 to rotate wheel 70 into the third position so that designation number 3 appears in window 40. Wheel 70 is activated to move into the second or first positions when one paper cassette is installed under another paper cassette whose actuator rod is already partially or fully depressed. For example, and referring again to FIG. 6, when cassette 22 is installed under cassette 25, cam 76 in cassette 25 engages and partially depresses actuator rod 74 in cassette 22 so that designation number 4 appears in window 40.

Figure 7:
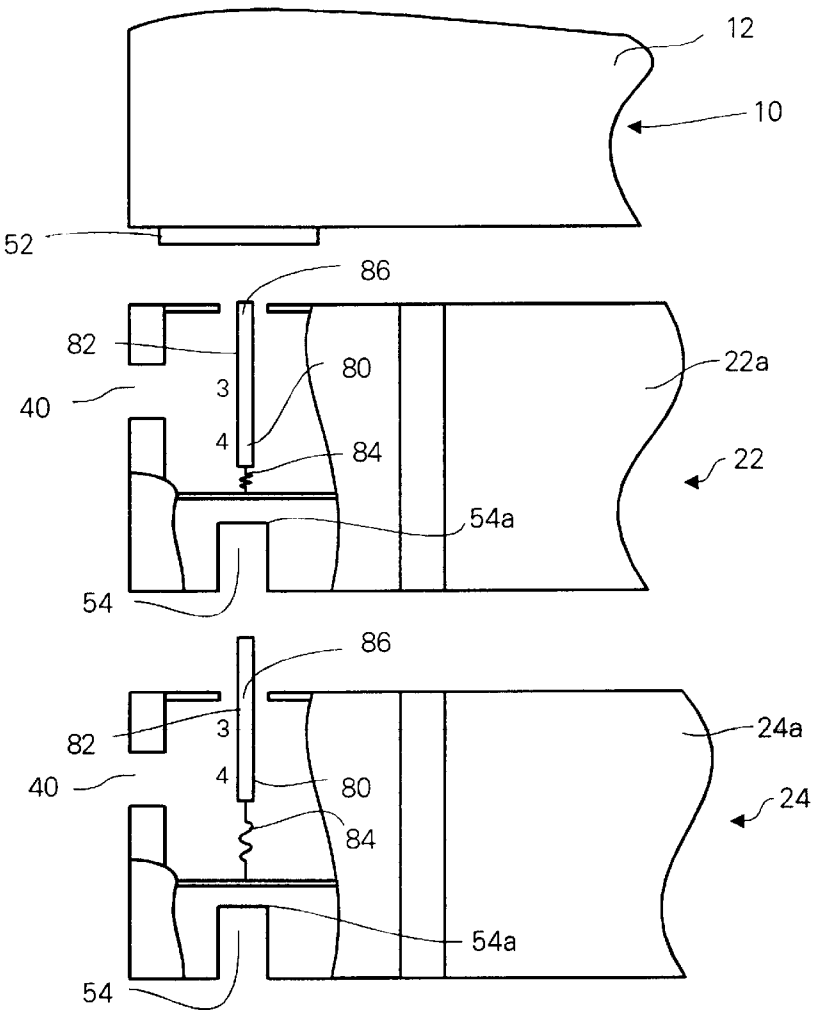
FIG. 7 is an exploded side view of a printer and paper cassettes that use a multiple position designator bar.

In another embodiment of the invention shown in FIG. 7, a vertical designator bar is used to designate the optional paper cassettes. Referring to FIG. 7, designator bar 80 is positioned in the viewing window 40 of each paper cassette housing 22*a,* 24*a*. The cassette designator numbers are printed on or otherwise affixed to the face 82 of bar 80. Bar 80 is operative to move between a first position, illustrated by cassette 24, and a second position, illustrated by cassette 22. When bar 80 is in the first position, cassette designation number 4 appears in window 40 and bar 80 is raised. When bar 80 is in the second position, cassette designation number 3 appears in window 40 and bar 80 is lowered. Bar 80 is biased to the first position by spring 84 or another suitable biasing mechanism.

Designator bar 80 is activated to move from the first position into the second position when the paper cassette is installed under the printer 10. As printer 10 is placed on top of the paper cassette, the bottom of main printer housing 12 depresses bar 80 into the second position. A void 54 is positioned directly below bar 80 at the bottom portion 32 of each cassette housing 22*a*, 24*a*. Void 54 is sized, shaped and positioned so that, when one paper cassette is stacked on top of another, the top 86 of designator bar 80 of the lower cassette extends into the void in the upper cassette. Preferably, void 54 is made deep enough so that no contact is made between the designator bar of the lower cassette and the back wall 54*a* of void 54 in the upper cassette. That is, the upper cassette does not engage or depress designator bar 80 of the lower cassette. Thus, the paper cassette installed immediately below the printer (cassette 22 in FIG. 7) will always be designated cassette number 3 and the other paper cassette (cassette 24 in FIG. 7) will always be designated cassette number 4.

Figure 8:
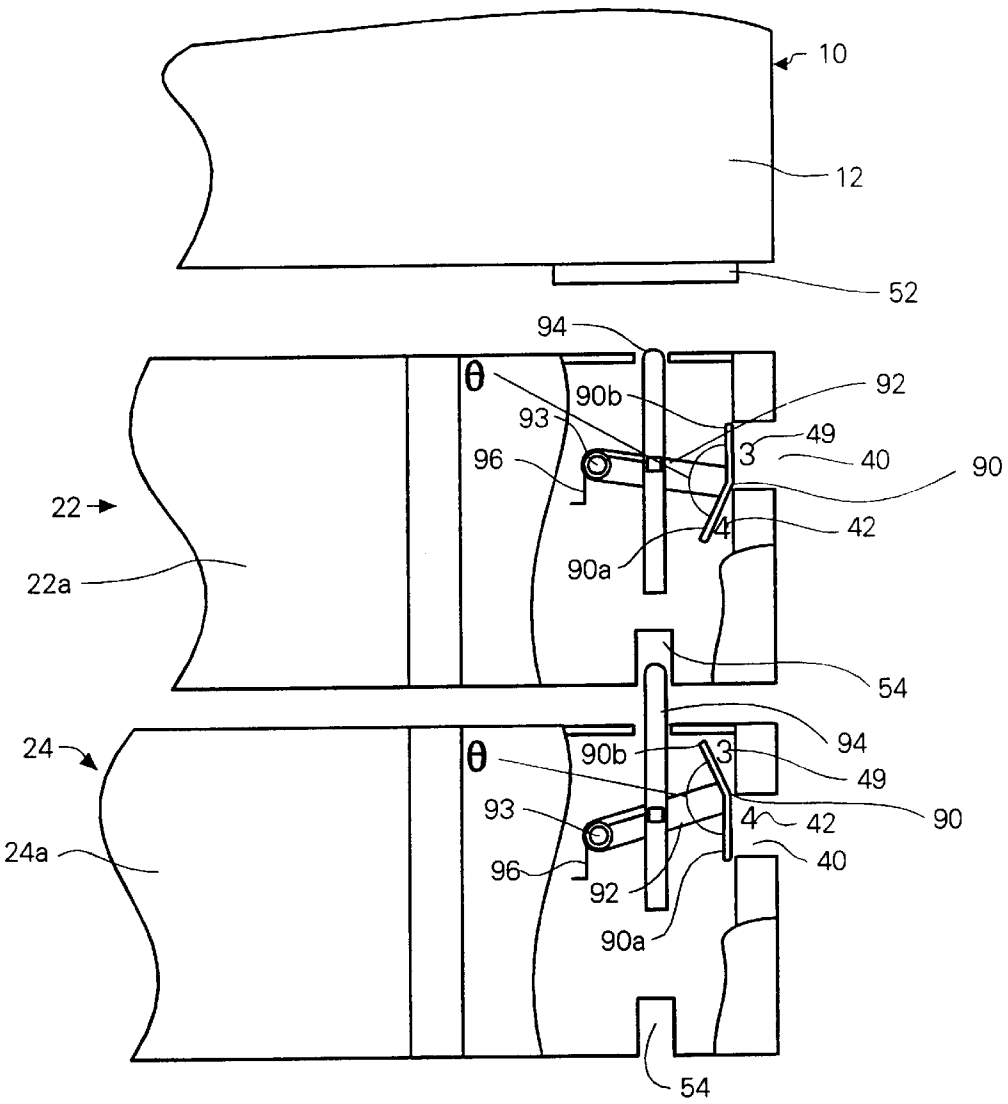
FIG. 8 is an exploded side view of a printer and paper cassettes that use a two position designator plate.

FIG. 8 illustrates a two position number designator face plate 90 used to designate the optional paper cassettes. Plate 90 has a bottom portion 90*a* and a top portion 90*b*. The first number designator 42 (number "4" in FIG. 8) appears on bottom portion 90*a* of plate 90. The second number designator 49 (number "3" in FIG. 8) appears on the top portion 90*b* of plate 90. Plate 90 is attached to one end of a shaft 92 at the junction of its bottom and top portions 90*a* and 90*b*. Shaft 92 is pivotally mounted to axle 93. Axle 93 is attached to the paper cassette housing 22*a*, 24*a* or another suitable fixed structure within the housing. An actuator rod 94 is attached to and pivots on shaft 92 at a point between plate 90 and axle 93 so that the bottom and top portions 90*a* and 90*b* alternately rotate into and out of view of window 40 when actuator rod 94 is pushed or pulled, as best seen by comparing the position of plate 90 in cassettes 22 and 24 in FIG. 8.

Face plate 90 is operative to move between a first position, illustrated by cassette 24, and a second position, illustrated by cassette 22. When face plate 90 is in the first position, cassette designation number 4 appears in window 40 and actuator rod 94 is raised. When face plate 90 is in the second position, cassette designation number 3 appears in window 40 and actuator rod 94 is lowered. Face plate 90 is biased to the first position by spring 96 or another suitable biasing mechanism. The bottom and top portions 90*a* and 90*b* are joined at an angle Θ. Angle Θ, the length of shaft 92 (that is, the distance between plate 90 and axle 93) and the point of attachment of actuator rod 94 are all selected so that the number designators affixed to the front of plate 90 are clearly displayed in window 40 when plate 90 is moved between the first and second positions.

Face plate 90 is activated to move from the first position into the second position when the paper cassette is installed under the printer 10. As printer 10 is placed on top of the paper cassette, the bottom of main printer housing 12 depresses face plate 90 into the second position. A void 54 is positioned directly below actuator rod 94 at the bottom portion 32 of each cassette housing 22*a*, 24*a*. Void 54 is sized, shaped and positioned so that, when one paper cassette is stacked on top of another, actuator rod 94 of the lower cassette extends into the void in the upper cassette. Preferably, void 54 is made deep enough so that no contact is made between the actuator rod of the lower cassette and the back wall 54*a* of void 54 in the upper cassette. That is, the upper cassette does not engage or depress actuator rod 94 of the lower cassette. Thus, the paper cassette installed immediately below the printer will always be designated cassette number 3 and the other paper cassette will always be designated cassette number 4.

The invention provides a system for designating individual paper holders in printers and copiers that use multiple paper holders. The designation system may be used to automatically differentiate between interchangeable paper holders installed immediately adjacent to one another. Alternative embodiments include an illuminated display and supporting circuitry to display a different indicator dependent upon the paper holder's position. For instance, the circuitry in each successive tray would become a part of a larger voltage divider circuit and a display on each tray would display a distinctive number based upon the voltage level of the tray's position within the circuit. Although the invention has been shown and described with reference to interchangeable optional paper cassette feeder units in a printer, the invented designator system may be incorporated into any of the various printers, copiers and other such image forming machines that use multiple paper holders, paper cassettes, paper trays and the like. Other alternative or additional forms and details of the invention may be made without departing from the spirit and scope of the invention as defined in the following claims.

What is claimed is:

1. A system for designating a paper holder used in printers, copiers or other image forming devices, the system comprising:

a. a designator connected to and viewable on the paper holder, the designator operable to move between a first position wherein the designator is not visible on the paper holder and a second position wherein the designator is visible on the paper holder; and b. an L shaped member characterized by a first leg having a first end pivotally attached to the paper holder, thereby defining a point of attachment between the L shaped member and the paper holder, and a second end joined at substantially a right angle to a second leg, the designator affixed to the second leg and the L shaped member operable to pivot the second leg and the designator affixed thereto about the point of attachment between the first position and the second position.

2. A system for designating a paper holder used in printers, copiers or other image forming devices, the system comprising:

a. a first designator affixed to and viewable on the paper holder;

b. an L shaped member characterized by a first leg having a first end pivotally attached to the paper holder, thereby defining a point of attachment between the L shaped member and the paper holder and a second end joined at substantially a right angle to a second leg;

c. a second designator affixed to the second leg of the L shaped member; and d. the L shaped member operable to pivot the second leg and the designator affixed thereto about the point of attachment between a first position in which only the first designator is visible on the paper holder and a second position in which only the second designator is visible.

3. A paper holder, comprising:

a. a housing;

b. a paper tray disposed within the housing;

c. a designator window in the housing;

d. a first designator viewable through the window;

e. an L shaped member characterized by a first leg and a second leg joined at substantially a right angle, the first leg pivotally attached to the housing above and adjacent to the window; and f. a second designator affixed to the second leg of the L shaped member the L shaped member operable to pivot the second leg and the designator affixed thereto between a first position wherein only the first designator is displayed in the window and a second position wherein only the second designator is displayed in the window.

4. A holder according to claim 3, wherein the L shaped member projects outside the housing when the second leg of the L shaped member is in the first position and the holder further comprises a void in the housing directly below the L shaped member, the void sized, shaped and positioned so that, when a first paper holder is installed immediately adjacent to a second paper holder, the L shaped member of the first paper holder projects into the void of the second paper holder and thus the second paper holder does not engage or depress the L shaped member of the first paper holder.

5. An apparatus for designating a paper supply in image forming devices, the apparatus comprising a designator operable to display one of at least two values, each value corresponding to a position of the paper supply in a group of similar paper supplies, the designator configured to automatically display one of the values in response to the position of the paper supply within the group of similar paper supplies.

6. A paper supply for supplying paper to an image forming device, the paper supply comprising:

a. a housing for holding the paper; and b. a designator attached to the housing, the designator operable to display one of at least two values, each value corresponding to a position of the housing in a group of similar housing, the designator configured to automatically display one of the values in response to the position of the housing within the group of similar housings.

7. A method for designating a paper supply in image forming devices, comprising:

providing a designator having at least two values displayable thereon, each value corresponding to a position of the paper supply in a group of similar paper supplies; and automatically displaying one of the values in response to the position of the paper supply in the group of paper supplies.

* * * * *